US010777127B2

(12) United States Patent
Ying et al.

(10) Patent No.: US 10,777,127 B2
(45) Date of Patent: Sep. 15, 2020

(54) ORGANIC ELECTROLUMINESCENT DISPLAY PANEL AND DISPLAY DEVICE

(71) Applicant: Shanghai Tianma Micro-Electronics Co., Ltd., Shanghai (CN)

(72) Inventors: Bian Ying, Shanghai (CN); Junhui Lou, Shanghai (CN); Zeshang He, Shanghai (CN)

(73) Assignee: SHANGHAI TIANMAN MICRO-ELECTRONICS CO., LTD., Shanghai (CN)

( * ) Notice: Subject to any disclaimer, the term of this patent is extended or adjusted under 35 U.S.C. 154(b) by 75 days.

(21) Appl. No.: 15/830,837

(22) Filed: Dec. 4, 2017

(65) Prior Publication Data

US 2018/0090063 A1 Mar. 29, 2018

(30) Foreign Application Priority Data

Oct. 19, 2017 (CN) ..... 2017 1 0979025

(51) Int. Cl.
*G09G 3/3225* (2016.01)
*G09G 3/20* (2006.01)

(52) U.S. Cl.
CPC ..... *G09G 3/3225* (2013.01); *G09G 3/2003* (2013.01); *G09G 2300/046* (2013.01); *G09G 2300/0452* (2013.01); *G09G 2300/0456* (2013.01); *G09G 2320/0233* (2013.01); *G09G 2320/0242* (2013.01)

(58) Field of Classification Search
None
See application file for complete search history.

(56) References Cited

U.S. PATENT DOCUMENTS

2011/0220908 A1* 9/2011 Kim ..... H01L 27/3246 257/72
2012/0280215 A1* 11/2012 Choi ..... H01L 27/326 257/40

(Continued)

FOREIGN PATENT DOCUMENTS

CN 103440822 A 12/2013
CN 103700692 A 4/2014

(Continued)

*Primary Examiner* — Christopher R Lamb
(74) *Attorney, Agent, or Firm* — Anova Law Group PLLC

(57) ABSTRACT

The present disclosure provides an organic electroluminescent display panel including a plurality of pixel cells arranged into a matrix on a base substrate. Each pixel cell includes at least two subpixels arranged next to each other along a first direction. Each subpixel includes a light transmission region, an opaque emission region, and an emission region arranged along a second direction with the opaque emission region being disposed between the light transmission region and the emission region. The second direction and the first direction are perpendicular to each other. For the at least two subpixels in each pixel cell, the opaque emission regions are arranged in one straight line along the first direction, the light transmission regions are arranged in two straight lines along the first direction, and the emission regions are also arranged in the two straight lines along the first direction in which the light transmission regions are arranged.

14 Claims, 9 Drawing Sheets

(56) References Cited

U.S. PATENT DOCUMENTS

| | | | | |
|---|---|---|---|---|
| 2015/0054719 | A1* | 2/2015 | Lee | G09G 3/3208 345/76 |
| 2016/0321982 | A1* | 11/2016 | Lee | G09G 3/3607 |
| 2018/0012942 | A1* | 1/2018 | Adachi | H01L 27/3216 |

FOREIGN PATENT DOCUMENTS

| | | | |
|---|---|---|---|
| CN | 104425554 | A | 3/2015 |
| CN | 105185812 | A | 12/2015 |
| CN | 106097979 | A | 11/2016 |

* cited by examiner

ORGANIC ELECTROLUMINESCENT DISPLAY PANEL AND DISPLAY DEVICE

CROSS-REFERENCES TO RELATED APPLICATIONS

This application claims the priority of Chinese patent application No. 201710979025.4, filed on Oct. 19, 2017, the entirety of which is incorporated herein by reference.

FIELD OF THE DISCLOSURE

The present disclosure generally relates to the field of display technology and, more particularly, relates to an organic electroluminescent display panel and a display device.

BACKGROUND

As a new display technology, transparent displays can allow viewers to see the background scene behind the display screen. This newly emerging display effect expands the scope of display applications, and can be used in various display devices such as mobile phones, notebook computers, display windows, refrigerator doors, car displays, billboards, etc.

However, existing transparent display panels may lead to a visual effect of interlaced brightness during display. Especially, when the pixel density, e.g. pixels per inch (PPI), is low, the visual effect of interlaced brightness may be particularly obvious. The disclosed organic electroluminescent display panel and display device are directed to solve one or more problems set forth above and other problems in the art.

BRIEF SUMMARY OF THE DISCLOSURE

One aspect of the present disclosure provides an organic electroluminescent display panel. The display panel includes a plurality of pixel cells arranged into a matrix on a base substrate. Each pixel cell includes at least two subpixels arranged next to each other along a first direction. Each subpixel includes a light transmission region, an opaque emission region, and an emission region arranged along a second direction with the opaque emission region being disposed between the light transmission region and the emission region. The second direction and the first direction are perpendicular to each other. For the at least two subpixels in each pixel cell, the opaque emission regions are arranged in one straight line along the first direction, the light transmission regions are arranged in two straight lines along the first direction, and the emission regions are also arranged in the two straight lines along the first direction in which the light transmission regions are arranged.

Another aspect of the present disclosure provides a display device. The display device includes an organic electroluminescent display panel described in the present disclosure.

Other aspects of the present disclosure can be understood by those skilled in the art in light of the description, the claims, and the drawings of the present disclosure.

BRIEF DESCRIPTION OF THE DRAWINGS

The following drawings are merely examples for illustrative purposes according to various disclosed embodiments and are not intended to limit the scope of the present disclosure.

DETAILED DESCRIPTION

Reference will now be made in detail to exemplary embodiments of the invention, which are illustrated in the accompanying drawings. Wherever possible, the same reference numbers will be used throughout the drawings to refer to the same or like parts.

Figure 1:
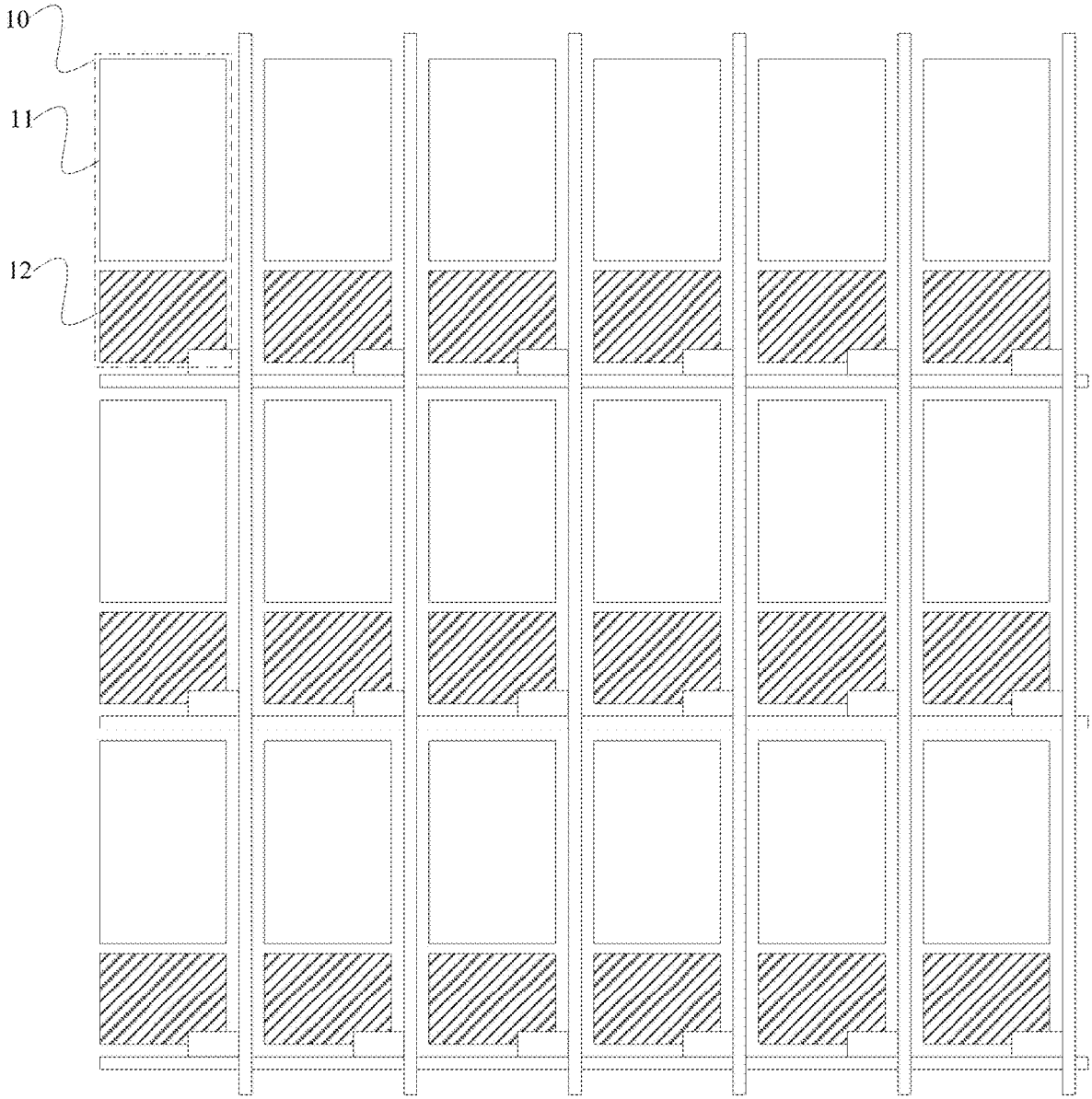
FIG. 1 (Prior Art)
FIG. 1 illustrates a schematic view of an existing transparent display panel.

FIG. 1 illustrates a schematic view of a conventional transparent display panel. As shown in FIG. 1, the conventional transparent display panel usually includes a plurality of pixel cells 10. Each pixel cell 10 includes an opaque region for disposing a display component 12. The display component 12 is driven to emit light such that the transparent display function is achieved. Each pixel cell 10 also includes a light transmission region 11. The light transmission region 11 allows light to be transmitted through such that the scene behind the display panel can be viewed. In order to meet the requirements for arranging wires to connect the plurality of display components 12, the opaque regions corresponding to the display components 12 need to be arranged in a plurality of straight lines, i.e. a plurality of rows. Therefore, the light transmission regions 11 and the opaque regions may together form an interlaced pattern, which may cause an interlacing display problem during display.

In order to eliminate the interlacing display problem, the light transmission regions 11 and the opaque regions in a transparent display panel can be arranged alternately along both the row direction and the column direction. Accordingly, the wires connecting to the display components 12 need to be changed from the straight lines, as shown in FIG. 1, to polylines in order to avoid the wires crossing the light transmission regions 11. Therefore, the wires connecting to the plurality of display components 12 may need to be longer. In the meantime, arranging the wires to connect the plurality of display components 12 may become more difficult. Moreover, increasing the length of the wires is equivalent to increasing the wiring area, and the increase in the wiring area may lead to an increase in the overall reflectance of the transparent display panel. As such, the transmittance of the transparent display panel may be degraded.

Figure 2:
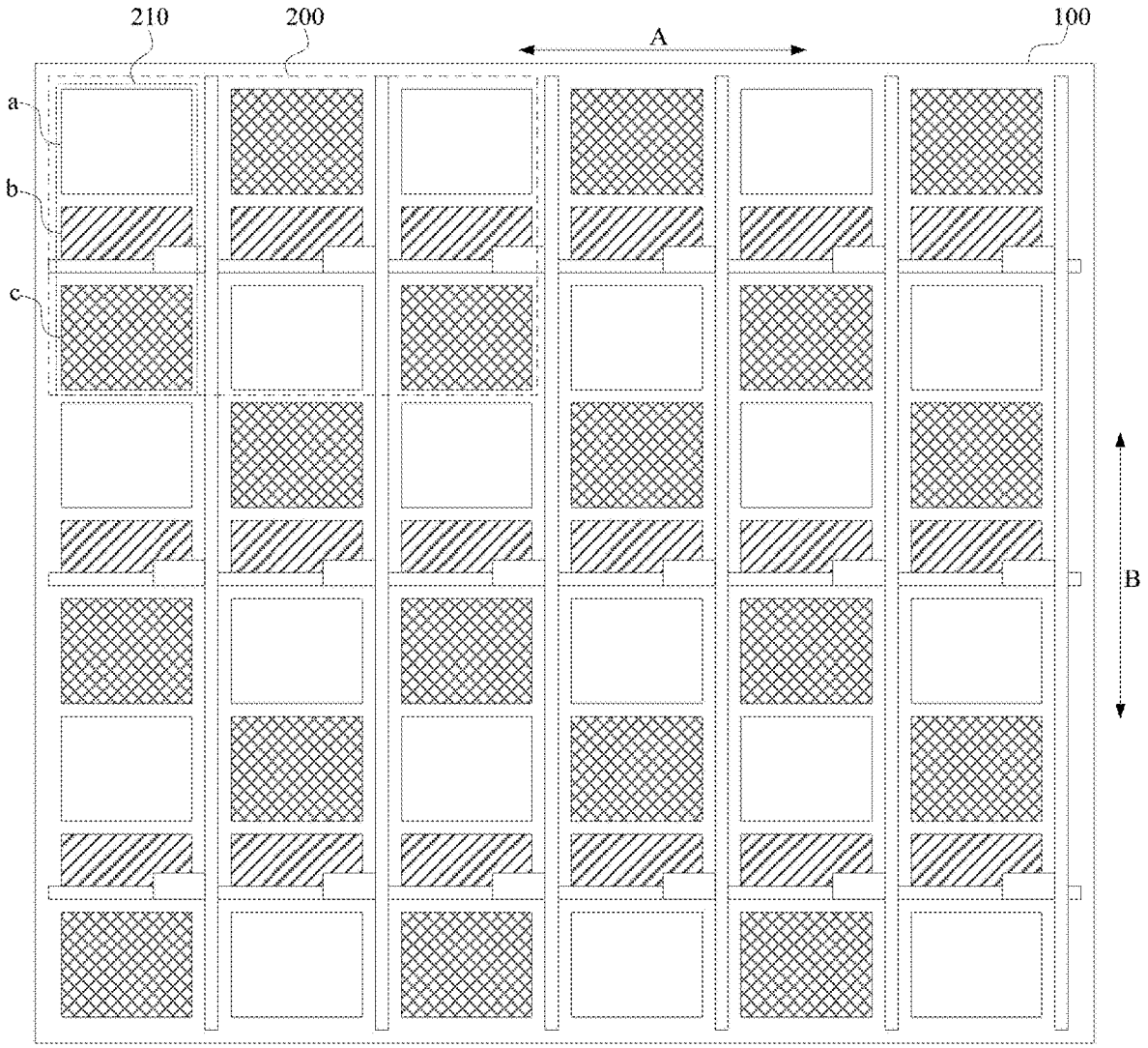
FIG. 2 illustrates a schematic view of an exemplary organic electroluminescent display panel consistent with some embodiments of the present disclosure.

The present disclosure provides an organic electroluminescent display panel to solve the interlacing display problem. FIG. 2 illustrates a schematic view of an exemplary organic electroluminescent display panel consistent with some embodiments of the present disclosure.

Referring to FIG. 2, the organic electroluminescent display panel may include a plurality of pixel cells 200 arranged into a matrix on a base substrate 100. Each pixel cell 200 may include at least two neighboring subpixels 210 along a first direction A. Along a second direction B, each subpixel 210 may include a light transmission region a, an opaque emission region b, and an emission region c. The second direction B and the first direction A may be perpendicular to each other.

In each subpixel 210, the opaque emission region b may be formed between the light transmission region a and the emission region c.

In each pixel cell 200, the opaque emission regions b of different subpixels 210 may be arranged in a single straight line along the first direction A. In addition, in each pixel cell 200, the light transmission regions a of different subpixels 210 may be arranged in two straight lines along the first direction A, and the emission regions c of different subpixels 210 may also be arranged in the two straight lines that the light transmission regions a are arranged in. That is, the light transmission regions a and the emission regions c of the subpixels 210 in each pixel cell 200 may be arranged in different lines, i.e., two straight lines along the first direction A, and each of the two straight lines may include at least one light transmission region a and at least one emission region c.

For example, in each pixel cell 200 of an organic electroluminescent display panel consistent with the embodiment described above, the opaque emission regions b are arranged in a straight line along the first direction A. Moreover, on the two sides of the opaque emission regions b, the light transmission regions a and the emission regions c may be arranged in two straight lines with each of the straight line extending along the first direction A. That is, on each side of the straight line formed by the opaque emission regions b in the pixel cell 200, at least one light transmission region a and at least one emission region c may together form a straight line extending along the first direction A. The total number of the light transmission regions a and the emission regions c in the straight line may be equal to the number of the subpixels 210 in the pixel cell 200.

Therefore, the possibility of having two or more interconnected light transmission regions a may be limited, and thus the area corresponding to two or more interconnected light transmission regions a may be reduced. As such, the visual effect of interlaced brightness may be eliminated, and the display result may be improved. Moreover, because the wires used to control light emission may be disposed in the opaque emission regions b, which are arranged in a straight line along the first direction A, the length of the wires running through the opaque emission regions b may be reduced and the challenge in disposing the wires in the opaque emission regions b may also be reduced.

In one embodiment, the first direction A may be the row direction of the matrix formed by the plurality of pixel cells 200, and accordingly, the second direction B may be the column direction of the matrix formed by the plurality of pixel cells 200. Alternatively, the first direction A may be the column direction of the matrix formed by the plurality of pixel cells 200, and accordingly, the second direction B may be the row direction of the matrix formed by the plurality of pixel cells 200.

In one embodiment, each pixel cell 200 may include a plurality of subpixels 210, and the plurality of subpixels 210 in each pixel cell 200 may have different colors. For illustrative purposes, in one embodiment, each pixel cell 200 is described to include three subpixels 200 and the colors of the three subpixels 200 are described to be red (R), green (G), and blue (B), respectively. In other embodiments, the number of subpixels in each pixel of the organic electroluminescent display panel may be different from three, and/or the colors of the subpixels may not be limited to R, G, and B. Any appropriate number of subpixels and/or colors may be used.

Further, FIGS. 3-9 illustrate schematic views of exemplary subpixels of organic electroluminescent display panels consistent with various embodiments of the present disclosure. For illustrative purposes, only one subpixel 210 (referring to FIG. 2) is shown in each figure although the display panel may include a plurality of subpixels 210.

Referring to FIGS. 3-9, each subpixel 210 (referring to FIG. 2) may include a light-emitting drive circuit 211, a reflective electrode 212, and an organic light-emitting structure 213 stacked in sequence on the base substrate 100. Moreover, the organic light-emitting structure 213 may be formed at least in the emission region c and the opaque emission region b, the light-emitting drive circuit 211 may be formed only in the opaque emission region b, and the reflective electrode 212 may be formed at least in the opaque emission region b.

Figure 3:
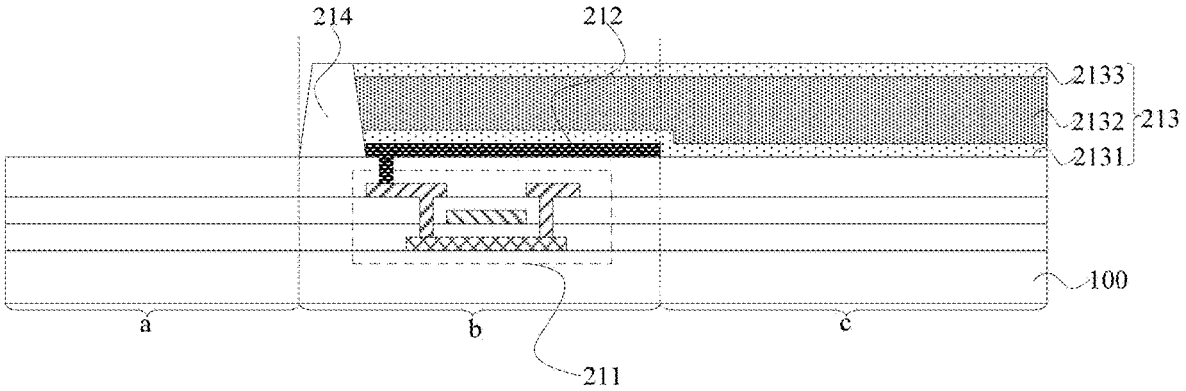
FIG. 3 illustrates a schematic view of an exemplary subpixel of an organic electroluminescent display panel consistent with some embodiments of the present disclosure.

Specifically, as shown in FIG. 3, the reflective electrode 212 of the subpixel is formed in the opaque emission region b, and the organic light-emitting structure 213 of the subpixel is formed in the emission region c and the opaque emission region b.

Figure 4:
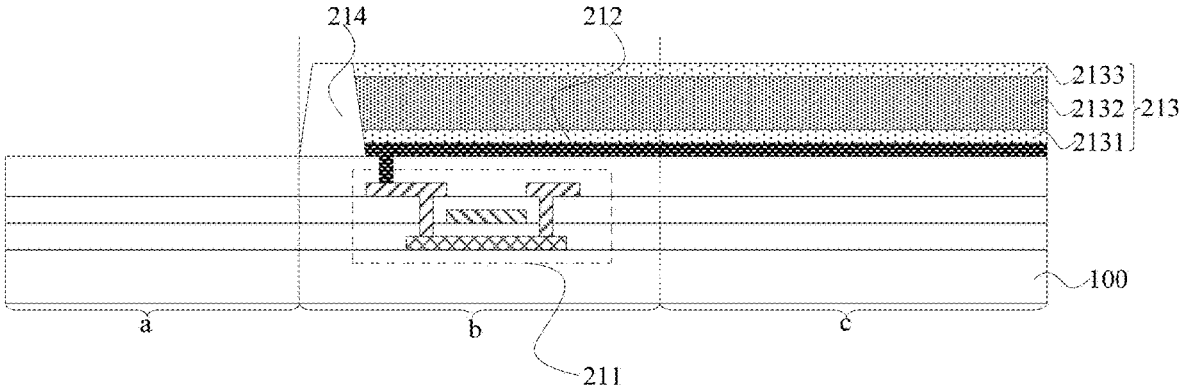
FIG. 4 illustrates a schematic view of another exemplary subpixel of an organic electroluminescent display panel consistent with some embodiments of the present disclosure.

As shown in FIG. 4, both the reflective electrode 212 and the organic light-emitting structure 213 of the subpixel are formed in the emission region c and the opaque emission region b.

Figure 5:
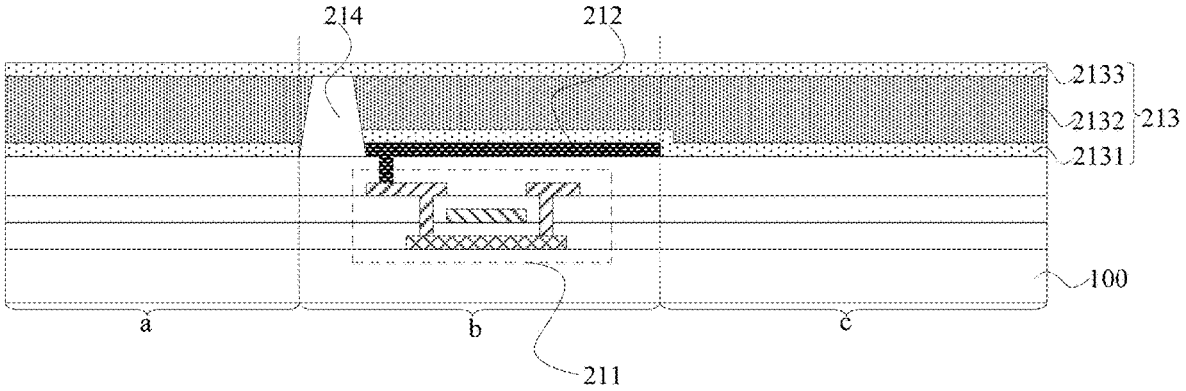
FIG. 5 illustrates a schematic view of another exemplary subpixel of an organic electroluminescent display panel consistent with some embodiments of the present disclosure.

As shown in FIG. 5, the reflective electrode 212 of the subpixel is formed in the opaque emission region b, and the organic light-emitting structure 213 of the subpixel is formed in the emission region c, the opaque emission region b, and the light transmission region a.

Figure 6:
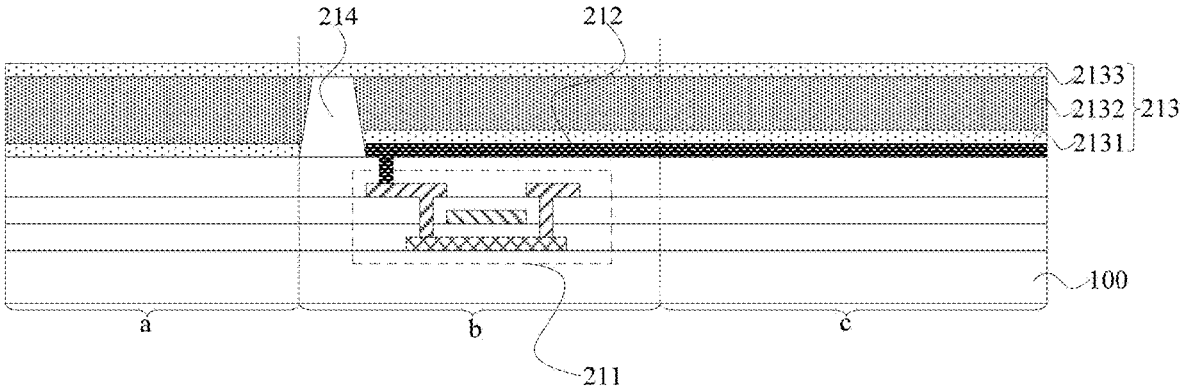
FIG. 6 illustrates a schematic view of another exemplary subpixel of an organic electroluminescent display panel consistent with some embodiments of the present disclosure.

As shown in FIG. 6, the reflective electrode 212 of the subpixel is formed in both the emission region c and the opaque emission region b, and the organic light-emitting structure 213 of the subpixel is formed in the emission region c, the opaque emission region b, and the light transmission region a.

Figure 7:
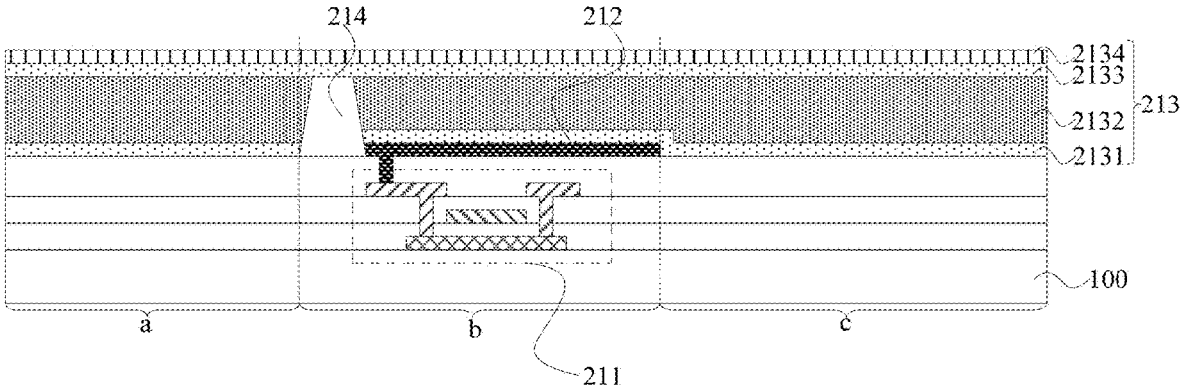
FIG. 7 illustrates a schematic view of another exemplary subpixel of an organic electroluminescent display panel consistent with some embodiments of the present disclosure.

As shown in FIG. 7, the reflective electrode 212 of the subpixel is formed in the opaque emission region b, and the organic light-emitting structure 213 of the subpixel is formed in the emission region c, the opaque emission region b, and the light transmission region a. In addition, a first color resist 2134 is formed in the emission region c, the opaque emission region b, and the light transmission region a, and covers the surface of the organic light structure 213 away from the substrate 100.

Figure 8:
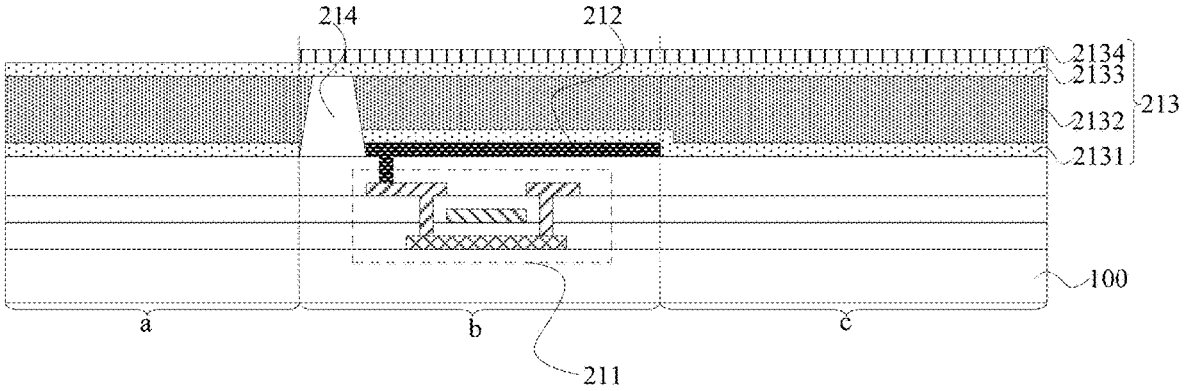
FIG. 8 illustrates a schematic view of another exemplary subpixel of an organic electroluminescent display panel consistent with some embodiments of the present disclosure.

As shown in FIG. 8, the reflective electrode 212 of the subpixel is formed in the opaque emission region b, and the organic light-emitting structure 213 of the subpixel is formed in the emission region c, the opaque emission region b, and the light transmission region a. In addition, a first color resist 2134 is formed in the emission region c and the opaque emission region b, and covers the surface of the organic light structure 213 away from the substrate 100.

Figure 9:
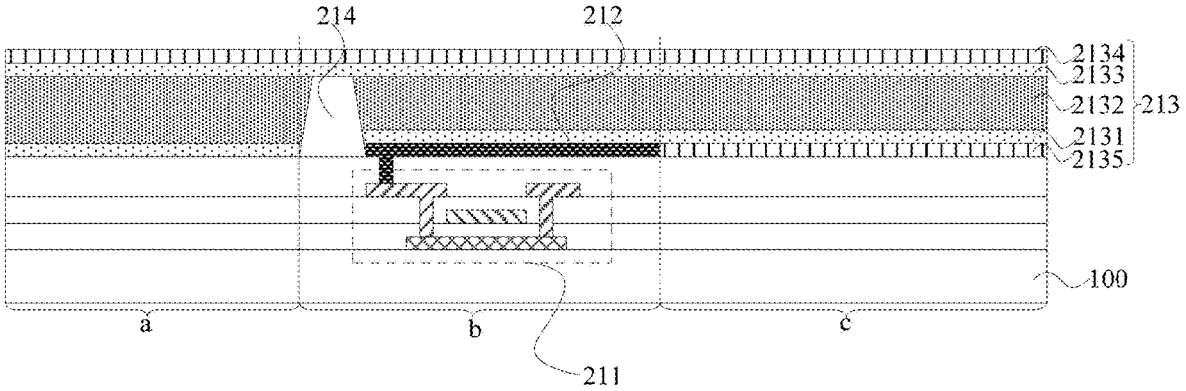
FIG. 9 illustrates a schematic view of another exemplary subpixel of an organic electroluminescent display panel consistent with some embodiments of the present disclosure.

As shown in FIG. 9, the reflective electrode 212 of the subpixel is formed in the opaque emission region b, and the organic light-emitting structure 213 of the subpixel may be formed in the emission region c, the opaque emission region b, and the light transmission region a. In addition, a first color resist 2134 is formed in the emission region c, the opaque emission region b, and the light transmission region a, and covers the surface of the organic light structure 213 away from the substrate 100. Moreover, a second color resist 2135 is formed in the emission region c, and between the organic light structure 213 and the substrate 100.

According to the disclosed organic electroluminescent display panels, the opaque emission regions b of the subpixels 210 of the plurality of pixel cells 200 (referring to FIG. 2) are arranged in a plurality of straight lines along the first direction A, and the light-emitting drive circuit 211 in each subpixel is formed only in the opaque emission region b. Therefore, the wires connecting to the plurality of light-emitting drive circuit 211 may extend along the first direction A. As such, the length of the wires may be reduced and the challenge in arranging the wires may also be reduced.

In some embodiments, referring to FIGS. 3, 5, and 7-9, the reflective electrode 212 may be formed only in the opaque emission region b. As such, the portion of the organic light-emitting structure 213 in the opaque emission region b may form a top emission structure, and the portion of the organic light-emitting structure 213 in the emission region c may form a double-sided emission structure. In the display mode, the surface of the base substrate 100 facing the organic light-emitting structure 213 may be the display surface, and the emission region c and the opaque emission region b may together form a light-emitting display area on the display surface. Therefore, the presence of the emission region c may increase the display brightness. In the non-display mode, the scene behind the display panel may be viewable due to light transmission through the emission region c and the light transmission region a. Therefore, the presence of the emission region c may improve the light-transmitting area.

In some other embodiments, referring to FIGS. 4 and 6, the reflective electrode 212 may be formed in both the opaque emission region b and the emission region c. Accordingly, the organic light-emitting structure 213 in the opaque emission region b and the emission region c may form a top emission structure.

According to the disclosed organic electroluminescent display panels, the organic light-emitting structure 213 formed in the emission region c and the opaque emission region b may be physically continuous to ensure that the light-emitting drive circuit 211 can control the organic light-emitting structure 213 to simultaneously emit light in both the emission region c and the opaque emission region b.

Further, in some embodiments, referring to FIGS. 3 and 4, the organic light-emitting structure 213 may be formed only in the emission region c and the opaque emission region b. Alternatively, in some other embodiments, referring to FIGS. 5-9, the organic light-emitting structure 213 may be formed in the light transmission region a, the emission region c, and the opaque emission region b. In the later scenario, in order to ensure that the portion of the organic light-emitting structure 213 in the light transmission region a does not emit light and thus affect the light transmission performance, the organic light-emitting structure 213 needs to be at least partially cut off at the boundary between the light transmission region a and the opaque emission region b such that the signal of the light-emitting drive circuit 211 may not be transmitted to the portion of the organic light-emitting structure 213 formed in the light transmission region a.

According to the disclosed organic electroluminescent display panels, the light-emitting drive circuit 211 is usually formed by a plurality of thin-film transistors. Referring to FIGS. 3-9, for illustrative purposes, only one transistor is shown in each figure. In other embodiments, the light-emitting drive circuit may have any other appropriate structure.

Further, referring to FIGS. 3-6, in some embodiments, the organic light-emitting structure 213 may usually include a first transparent electrode 2131, an electroluminescent material layer 2132, and a second transparent electrode 2133 disposed in sequence on the base substrate 100.

Specifically, the first transparent electrode 2131 may be usually connected to the light-emitting drive circuit 211, and the second transparent electrode 2133 may be usually set to a fixed voltage potential. In order to ensure the light transmission performance of the emission region c, the film layers constituting the organic light-emitting structure 213 may all be transparent. In addition, the organic light-emitting structure 213 may also include one or more functional film layers, such as a hole transport layer, etc.

According to the disclosed organic electroluminescent display panels, the electroluminescent material layers 2132 in the subpixels 210 of each pixel cell 200 may emit light in different colors. That is, the electroluminescent material layers 2132 in the subpixels 210 of each pixel cell 200 may be made of different materials. For example, in each pixel cell 200, the colors of the light emitted by the electroluminescent material layers 2132 of different subpixels 210 may usually include red, blue, green, and other appropriate colors.

In some embodiments, each pixel cell 200 may include at least one subpixel 210 emitting white light. That is, in each pixel cell 200, the electroluminescent material layer 2132 of at least one subpixel may emit white light. The white-light-emitting subpixels 210 may be able to improve the display brightness of the pixel cell 200.

In some embodiments, the electroluminescent material layer 2132 in each subpixel 210 of the plurality of pixel cells 200 may be able to emit white light. In such a case, as shown in FIGS. 7-8, in order to allow different subpixels 210 in a same pixel cell 200 to emit light in different colors, the organic light-emitting structure 213 may also include a first color resist 2134 formed on the second transparent electrode 2133 in opposite to the electroluminescent material layer 2132. In each pixel cell 200, the first color resists 2134 of different subpixels 210 may have different colors.

For example, because the first color resist 2134 is usually made of a transparent material, as shown in FIG. 7, the first color resist 2134 may cover the entire area of the subpixel 210. That is, the first color resist 2134 may be formed in the light transmission region a, the opaque emission region b, and the emission region c. Alternatively, referring to FIG. 8, the first color resist 2134 may be formed only in the opaque emission region b and the emission region c.

In some embodiments, the reflective electrode 212 may be formed only in the opaque emission region b. Accordingly, as shown in FIG. 9, the organic light-emitting structure 213 may also include a second color resist 2135 formed on the first transparent electrode 2131 in opposite to the electroluminescent material layer 2132. The first color resist 2134 and the second color resist 2135 in a same subpixel 210 may have a same color.

In one embodiment, the reflective electrode 212 is formed only in the opaque emission region b, and no second color resist 2135 is formed on the surface of the first transparent electrode 2131. During display, while the display content may be viewable on the side close to the second transparent electrode 2133, light may be emitted to the side close to the first transparent electrode 2131. That is, when the subpixel 210 is driven to display on the side of the display panel that faces to the second transparent electrode 2133, light may be emitted to the other side of the display panel that faces to the first transparent electrode 2131.

In another embodiment, the reflective electrode 212 is formed only in the opaque emission region b, and a second color resist 2135 is disposed on the first transparent electrode 2131 in opposite to the electroluminescent material layer 2132. During display, while the display content may be viewable on the side closed to the second transparent electrode 2133, the display content may also be viewable on the side close to the first transparent electrode 2131. That is, when the subpixel 210 is driven to display on the side of the display panel that faces to the second transparent electrode 2133, because of the presence of the second color resist 2135 on the first transparent electrode 2131, the display may also be achieved on the side of the display panel that faces to the first transparent electrode 2131.

In some embodiments, referring to FIGS. 3-9, in each subpixel 210, a pixel restriction layer 214 may be disposed on the light-emitting drive circuit 211. The pattern of the pixel restriction layer 214 may surround the emission region c and the opaque emission region b.

In some embodiments, referring to FIGS. 5-9, the organic light-emitting structure 213 may also be formed in the light transmission region a. In addition, the first transparent electrode 2131 and the electroluminescent material layer 2132 of the organic light-emitting structure 213 may be disconnected at the pixel restriction layer 214, and the second transparent electrode 2133 may be formed as a single piece over the entire area of the base substrate 100, including the light transmission region a, the emission region c, and the opaque emission region b.

For example, the pattern of the pixel restriction layer 214 may surround the emission region c and the opaque emission region b. That is, the light transmission region a may be isolated from the opaque emission region b by the pixel restriction layer 214. Therefore, the first transparent electrode 2131 and the electroluminescent material layer 2132 may be disconnected at the pixel restriction layer 214. That is, the presence of the pixel restriction layer 214 may ensure the disconnection between the portion of the first transparent electrode 2131 and the electroluminescent material layer 2132 formed in the light transmission region a and the portion of the first transparent electrode 2131 and the electroluminescent material layer 2132 formed in the opaque emission region b. As such, during the process to fabricate the organic light-emitting structure 213, each of the first transparent electrode 2131, the electroluminescent material layer 2132, and the second transparent electrode 2133 may be formed by coating the entire surface without introducing any patterning process.

Figure 10:
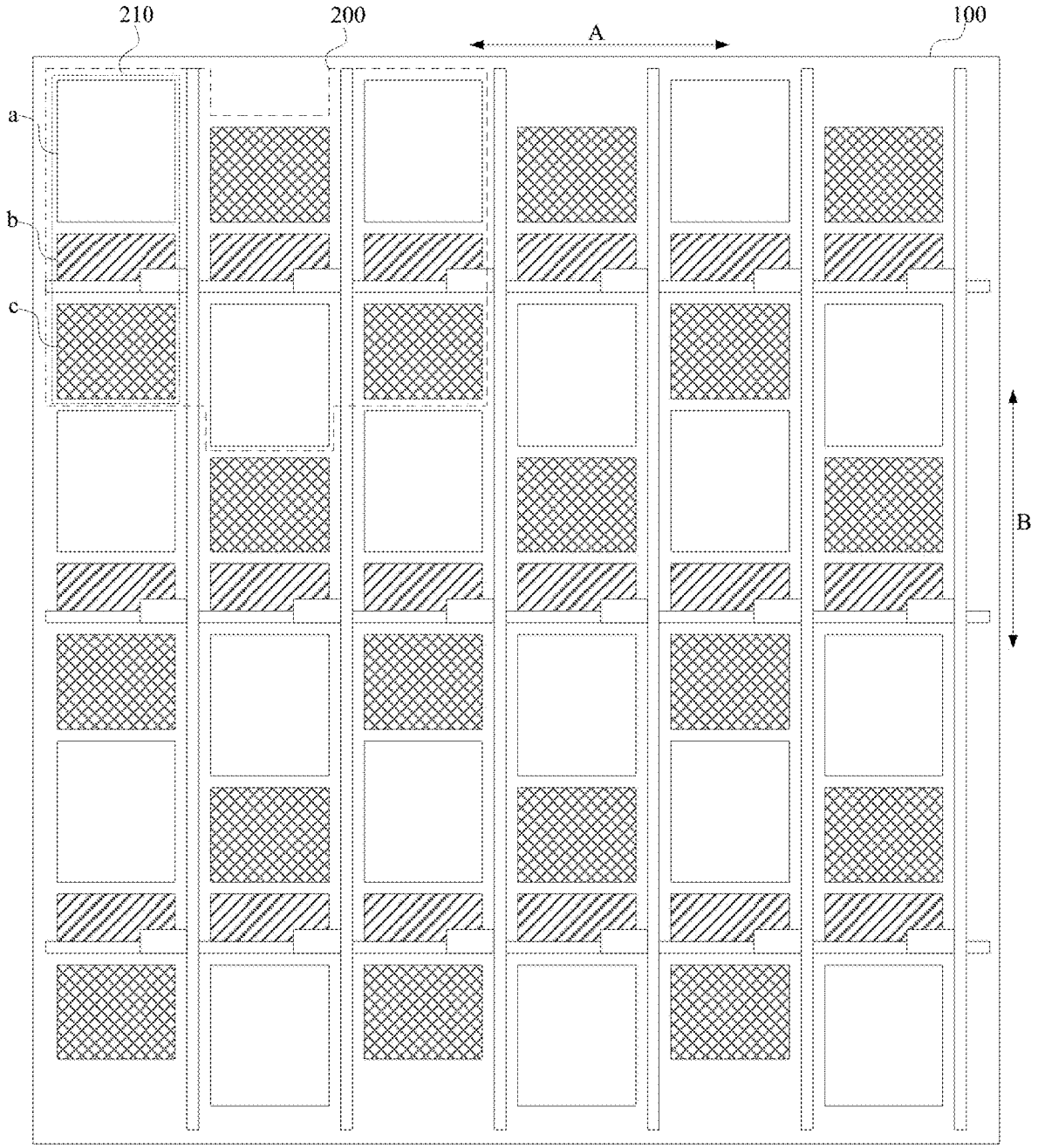
FIG. 10 illustrates a schematic view of another exemplary organic electroluminescent display panel consistent with some embodiments of the present disclosure.

FIG. 10 illustrates a schematic view of another exemplary organic electroluminescent display panel consistent with some embodiments of the present disclosure. Referring to FIG. 2 and FIG. 10, in some embodiments, the opaque emission regions b in different subpixels 210 may have a same area ratio with respect to the corresponding subpixels 210.

In some embodiments, referring to FIG. 10, in each subpixel 210, the area occupied by the light transmission region a may be the same as the total area occupied by the opaque emission region b and the emission region c.

Further, having the area occupied by the light transmission region a equal to the total area occupied by the opaque emission region b and the emission region c may ensure the light-transmitting area and the light-emitting area each occupying 50% of the area of the subpixel 210. In some other embodiments, in order to control the luminous brightness, the ratio of the light transmission region a to the emission region c may be adjusted according to the actual needs.

Referring to FIG. 2 and FIG. 10, in some embodiments, the plurality of light transmission regions a and the plurality of emission regions c may be arranged alternately in a plurality of straight lines along the first direction A.

Specifically, by arranging the light transmission regions a and the emission regions c alternately, the light transmission regions a and the light emission regions may be distributed more uniformly such that the uniformity of the colors may be improved, the visual effect of interlaced brightness may be eliminated, and the display result may also be improved.

Figure 11:
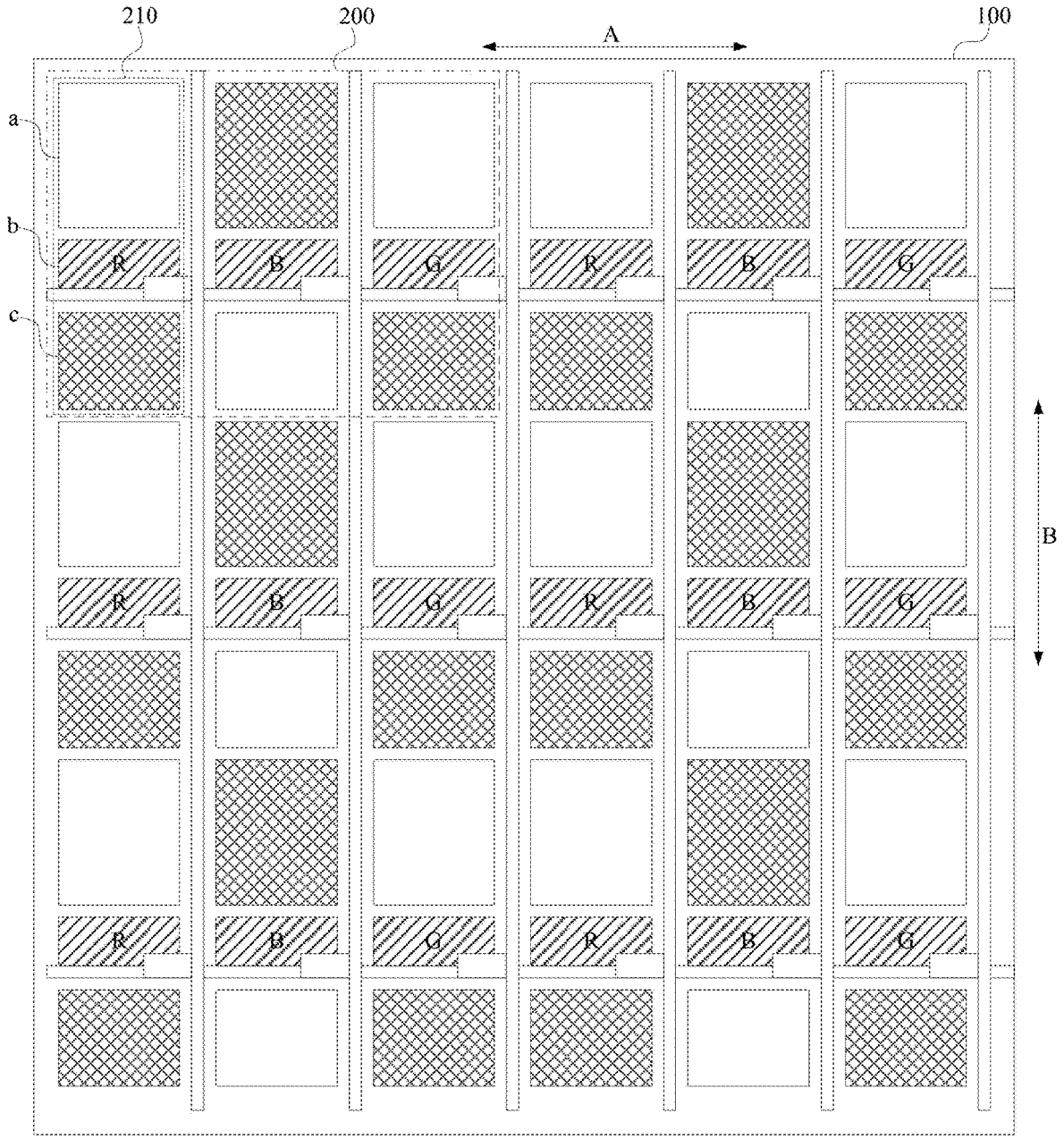
FIG. 11 illustrates a schematic view of another exemplary organic electroluminescent display panel consistent with some embodiments of the present disclosure.
Figure 12:
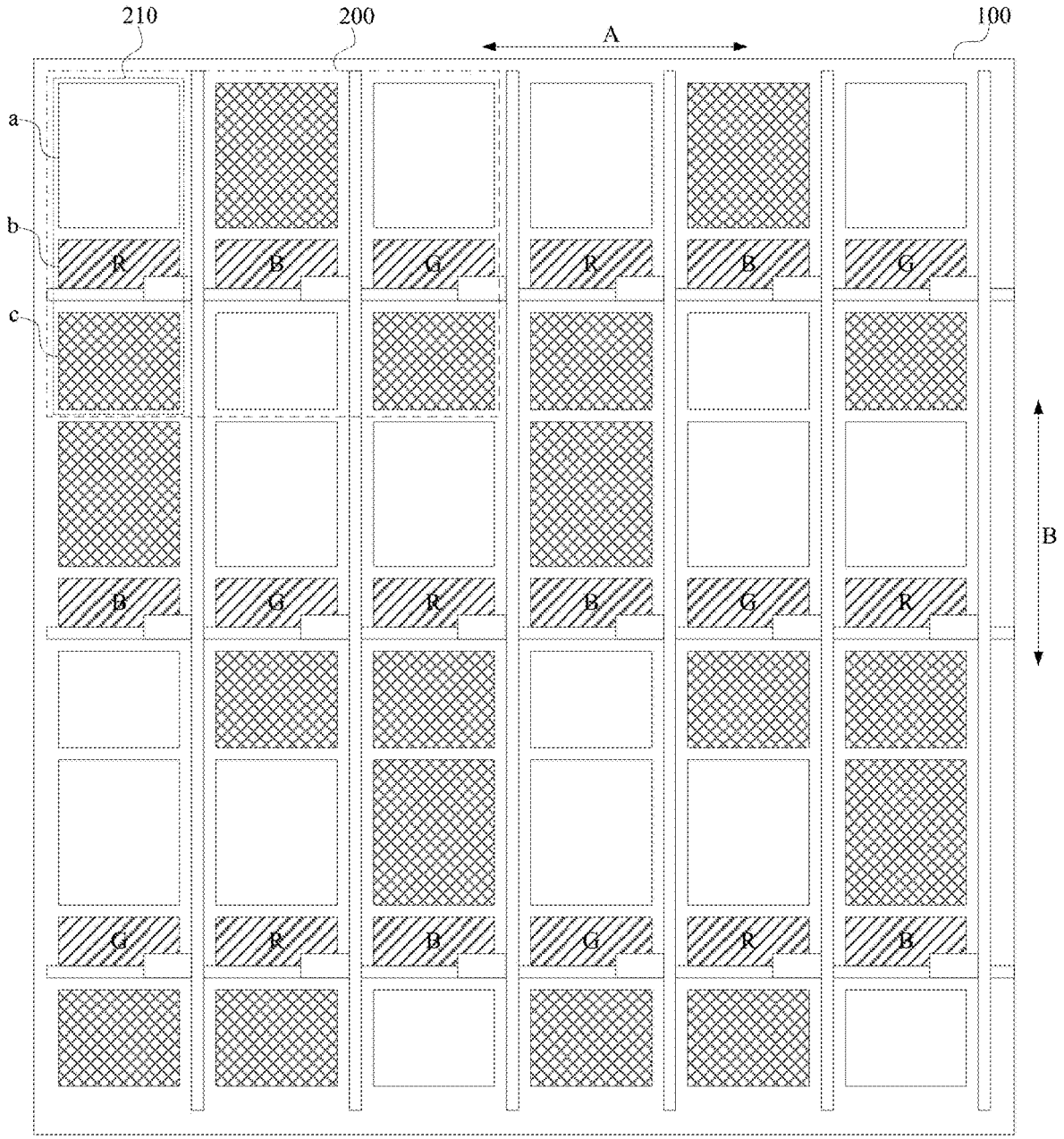
FIG. 12 illustrates a schematic view of another exemplary organic electroluminescent display panel consistent with some embodiments of the present disclosure.

FIG. 11 illustrates a schematic view of another exemplary organic electroluminescent display panel consistent with some embodiments of the present disclosure. FIG. 12 illustrates a schematic view of another exemplary organic electroluminescent display panel consistent with some embodiments of the present disclosure. Referring to FIG. 11 and FIG. 12, in each pixel cell 200, the area occupied by the emission region c in a subpixel 210 with the lowest light emission efficiency may be larger than the area occupied by each emission region c in other subpixels 210.

Specifically, in each pixel cell 200, the light emission efficiency may be different for different subpixels 210. In order to eliminate the difference in the brightness of the colors, because the areas of the opaque emission regions b in different subpixels 210 are substantially the same, the area of the emission region c in each subpixel 210 with the lowest light emission efficiency may be increased to improve the brightness of the light.

For example, referring to FIG. 11 and FIG. 12, in the subpixels 210 with the lowest light emission efficiency, the area of the emission region c may be equal to the total area of the opaque emission region b and the light transmission region a. In other subpixels 210, the area of the light transmission region a may be equal to the total area of the opaque emission region b and the emission region c. As such, in addition to eliminating the difference in the brightness of the colors, the arrangement of subpixels 210 may also ensure that the plurality of subpixels 210 are aligned, which is conducive to arranging the plurality of pixel cells 200.

Referring to FIG. 12, in some embodiments, the colors of the light emitted by any two neighboring subpixels 210 in a straight light along the second direction B may be different.

Specifically, by arranging the subpixels 210 with different colors alternately along the second direction B, the uniformity of the colors may be improved, which may be conducive to eliminating the impact of the colors difference between lines.

In some embodiments, referring to FIG. 12, in a straight line along the second direction B, it is possible to have the light transmission regions a of two neighboring subpixels 210 next to each other.

Specifically, in a straight line either along the second direction B or along the first direction A, the layout of the pixel cells 200 may have the light transmission regions a of two neighboring subpixels 210 next to each other. As such, the distribution regularity of the light transmission regions a may be further reduced, and thus the influence of the light transmission regions a on the difference in the brightness may be minimized.

Further, the subpixels 210 with the lowest light emission efficiency may be arranged uniformly. As such, the uniformity of the colors may be improved, which may be conducive to eliminating the impact of the color difference between lines.

Referring to FIG. 12, in some embodiments, the subpixels 210 with the lowest light emission efficiency are usually blue subpixels B. Therefore, as shown in FIG. 12, the area of each emission region c in the blue subpixels B may be formed larger than the area of any emission region c in subpixels 210 with other colors. In FIG. 12, regions with a same filled pattern represent a same type of region. For example, the plurality of emission regions c in different subpixels 210 may all be filled by a double-slash pattern, and the plurality of opaque emission regions b may all be filled by a single-slash pattern. As shown in FIG. 12, the area of each emission region c in the blue subpixels B may be larger than the area of the emission region c in either the red subpixels R or the green subpixels G. Accordingly, in the case that the areas of the opaque emission regions b in different subpixels 210 are the same, the area of each light transmission region a in the blue subpixels B may be smaller than the area of the light transmission region a in the red subpixels R or the green subpixels G.

Figure 13:
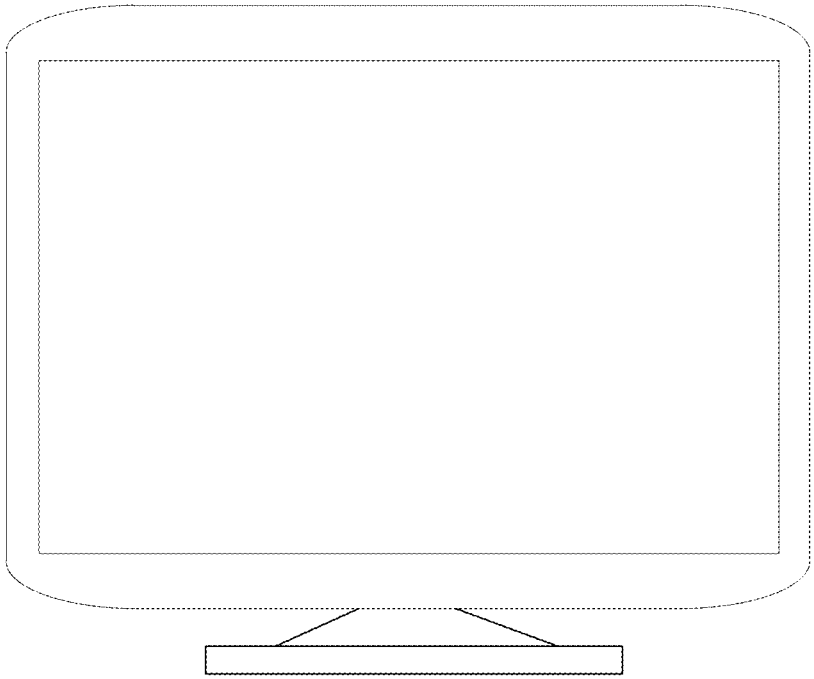
FIG. 13 illustrates a schematic view of an exemplary display device consistent with some embodiments of the present disclosure.

Further, the present disclosure also provides a display device. FIG. 13 illustrates a schematic view of an exemplary display device consistent with some embodiments of the present disclosure. Referring to FIG. 13, the display device may include an organic electroluminescent display panel according to the present disclosure. For example, the display panel may be a cellphone, a tablet, a television, a monitor, a laptop computer, a digital camera, a navigation device, or any other product or component with a display function. Other indispensable components of the display device should be understood by those of ordinary skill in the art, and will not be described in detail herein again. In addition, the embodiments described in the present disclosure are merely examples of the implementation of the present invention, and thus should not be construed as limiting the scope of the present disclosure. Moreover, the implementation of the display device may be referred to the above embodiments of the disclosed organic electroluminescent display panels.

According to the disclosed organic electroluminescent display panels and display devices, each pixel cell includes at least two neighboring subpixels along a first direction of the arrangement, and each subpixel includes a light transmission region, an opaque emission region, and an emission region arranged along a second direction. Further, in each subpixel, the opaque emission region is disposed between the light emission region and the emission region. Moreover, in each pixel cell, a straight line extending along the first direction on each side of the opaque emission regions may include both the light transmission region and the emission region. Therefore, the area corresponding to two or more interconnected light transmission regions may be reduced. As such, the visual effect of interlaced brightness may be eliminated, and the display result may be improved. In addition, because the opaque emission regions of the subpixels are arranged in a straight line along the first direction, the wires used to control light emission may be disposed in the opaque emission regions. As such, the length of the wires running through the opaque emission regions may be reduced and the challenge in disposing the wires in the opaque emission regions may also be reduced.

The above detailed descriptions only illustrate certain exemplary embodiments of the present invention, and are not intended to limit the scope of the present invention. Those skilled in the art can understand the specification as whole and technical features in the various embodiments can be combined into other embodiments understandable to those persons of ordinary skill in the art. Any equivalent or modification thereof, without departing from the spirit and principle of the present invention, falls within the true scope of the present invention.

What is claimed is:

1. An organic electroluminescent display panel, comprising:

a plurality of pixel cells arranged into a matrix on a base substrate, wherein:

each pixel cell includes at least two subpixels arranged next to each other along a first direction;

each subpixel includes a light transmission region, an opaque emission region, and an emission region arranged along a second direction with the opaque emission region being disposed between the light transmission region and the emission region;

the second direction and the first direction are perpendicular to each other; and for the at least two subpixels in each pixel cell, the opaque emission regions are arranged in one straight line along the first direction, the light transmission regions are arranged in two straight lines along the first direction, and the emission regions are also arranged in the two straight lines along the first direction in which the light transmission regions are arranged, wherein each subpixel includes a light-emitting drive circuit, a reflective electrode, and an organic light-emitting structure stacked in sequence on the base substrate, wherein:

the organic light-emitting structure is formed at least in the emission region and the opaque emission region;

the light-emitting drive circuit is formed only in the opaque emission region; and the reflective electrode is formed at least in the opaque emission region, and wherein:

the organic light-emitting structure includes a first transparent electrode, an electroluminescent material layer, and a second transparent electrode disposed in sequence on the base substrate.

2. The organic electroluminescent display panel according to claim 1, wherein:

in each pixel cell, the electroluminescent material layers of different subpixels emit light in different colors.

3. The organic electroluminescent display panel according to claim 1, wherein:

each pixel cell includes at least one subpixel emitting white light.

4. The organic electroluminescent display panel according to claim 3, wherein the electroluminescent material layers in the subpixels of each pixel cell emit white light, and accordingly, the organic light-emitting structure in each subpixel further includes a first color resist formed on the second transparent electrode in opposite to the electroluminescent material layer, wherein in each pixel cell, the first color resists of different subpixels have different colors.

5. The organic electroluminescent display panel according to claim 4, wherein the reflective electrode is formed only in the opaque emission region, and accordingly, the organic light-emitting structure further includes a second color resist formed on the first transparent electrode in opposite to the electroluminescent material layer, wherein in each subpixel, the second color resist and the first color resist have a same color.

6. The organic electroluminescent display panel according to claim 1, wherein:

each subpixel includes a pixel restriction layer disposed on the light-emitting drive circuit, wherein a pattern of the pixel restriction layer surrounds the emission region and the opaque emission region;

the organic light-emitting structure is also formed in the light emission region;

each of the first transparent electrode and the electroluminescent material layer in the organic light-emitting structure disconnects at the pixel restriction layer; and the second transparent electrode is formed as a single piece over the base substrate.

7. The organic electroluminescent display panel according to claim 1, wherein:

the area ratio of the opaque emission region to the subpixel is identical for different subpixels.

8. An organic electroluminescent display panel, comprising:

a plurality of pixel cells arranged into a matrix on a base substrate, wherein:

each pixel cell includes at least two subpixels arranged next to each other along a first direction;

each subpixel includes a light transmission region, an opaque emission region, and an emission region arranged along a second direction with the opaque emission region being disposed between the light transmission region and the emission region;

the second direction and the first direction are perpendicular to each other; and for the at least two subpixels in each pixel cell, the opaque emission regions are arranged in one straight line along the first direction, the light transmission regions are arranged in two straight lines along the first direction, and the emission regions are also arranged in the two straight lines along the first direction in which the light transmission regions are arranged, wherein the area ratio of the opaque emission region to the subpixel is identical for different subpixels, and wherein:

in each pixel cell, an area of the emission region in a subpixel with a lowest emission efficiency is larger than an area of the emission region in each other subpixel with an emission efficiency higher than the lowest emission efficiency.

9. The organic electroluminescent display panel according to claim 8, wherein:

in each subpixel with the lowest emission efficiency, the area of the emission region is equal to a total area of the opaque emission region and the light transmission region; and in each other subpixel with an emission efficiency higher than the lowest emission efficiency, an area of the light transmission region is equal to a total area of the opaque emission region and the emission region.

10. The organic electroluminescent display panel according to claim 8, wherein:

in a straight line along the second direction, any two neighboring subpixels emit light in different colors.

11. The organic electroluminescent display panel according to claim 10, wherein:

a layout of the subpixels includes at least one pair of neighboring subpixels arranged in a straight line along the second direction and having the light transmission regions next to each other.

12. The organic electroluminescent display panel according to claim 11, wherein:

the subpixels with the lowest emission efficiency are uniformly distributed in the organic electroluminescent display panel.

13. The organic electroluminescent display panel according to claim 8, wherein:

the subpixels with the lowest emission efficiency are blue subpixels.

14. A display device, comprising:

an organic electroluminescent display panel, including:

a plurality of pixel cells arranged into a matrix on a base substrate, wherein:

each pixel cell includes at least two subpixels arranged next to each other along a first direction;

each subpixel includes a light transmission region, an opaque emission region, and an emission region arranged along a second direction with the opaque emission region being disposed between the light transmission region and the emission region;

the second direction and the first direction are perpendicular to each other; and for the at least two subpixels in each pixel cell, the opaque emission regions are arranged in one straight line along the first direction, the light transmission regions are arranged in two straight lines along the first direction, and the emission regions are also arranged in the two straight lines along the first direction in which the light transmission regions are arranged, wherein each subpixel includes a light-emitting drive circuit, a reflective electrode, and an organic light-emitting structure stacked in sequence on the base substrate, wherein:

the organic light-emitting structure is formed at least in the emission region and the opaque emission region;

the light-emitting drive circuit is formed only in the opaque emission region; and the reflective electrode is formed at least in the opaque emission region, and wherein:

the organic light-emitting structure includes a first transparent electrode, an electroluminescent material layer, and a second transparent electrode disposed in sequence on the base substrate.

* * * * *